US005329716A

United States Patent [19]

Fite

[11] Patent Number: 5,329,716

[45] Date of Patent: Jul. 19, 1994

[54] ILLUMINATED ADVERTISING BENCH

[76] Inventor: James H. Fite, 13395 SW. 1st Ter., Miami, Fla. 33184

[21] Appl. No.: 977,222

[22] Filed: Nov. 16, 1992

[51] Int. Cl.[5] ..... G09F 13/04

[52] U.S. Cl. ..... 40/575; 40/320; 297/217; 297/232; 362/131; 362/183

[58] Field of Search ..... 40/320, 541, 564, 575, 40/577; 297/217, 232; 52/38; 362/127, 131, 183, 253

[56] References Cited

U.S. PATENT DOCUMENTS

| | | | |
|---|---|---|---|
| 192,770 | 7/1877 | Lacomme et al. | 40/320 |
| 1,223,576 | 4/1917 | Gartrell | 297/217 |
| 1,550,001 | 8/1925 | Reininger | 40/572 |
| 1,639,085 | 8/1927 | Fohey | 40/320 X |
| 2,131,586 | 9/1938 | Dano | 40/320 |
| 4,843,525 | 6/1989 | Williams | 40/564 X |
| 4,848,017 | 7/1989 | Bailey et al. | 40/564 X |
| 4,973,951 | 11/1990 | Shigeta et al. | 40/572 X |
| 5,107,637 | 4/1992 | Robbins | 40/442 X |

FOREIGN PATENT DOCUMENTS

| | | | |
|---|---|---|---|
| 2668 | of 1873 | United Kingdom | 40/320 |

*Primary Examiner*—Kenneth J. Dorner
*Assistant Examiner*—Brian K. Green
*Attorney, Agent, or Firm*—Malloy & Malloy

[57] ABSTRACT

An outdoor advertising bench to be used as a medium upon which advertising indicia may be displayed and be clearly visible during the day and night, including a bench having a pair of spaced support members, a seating platform supportably disposed therebetween, and a seat back assembly supportably disposed between the support members, the seat back assembly having a pair of opposite side panels, and a back panel, mid panel, and front panel, disposed between the side panels. The front panel is transparent so as to make an exposed face of the mid panel visible therethrough, the exposed face of the mid panel having advertising indicia and high visibility lights thereon to draw attention to the advertising indicia and to provide an attractive appearance.

11 Claims, 1 Drawing Sheet

FIG. 1
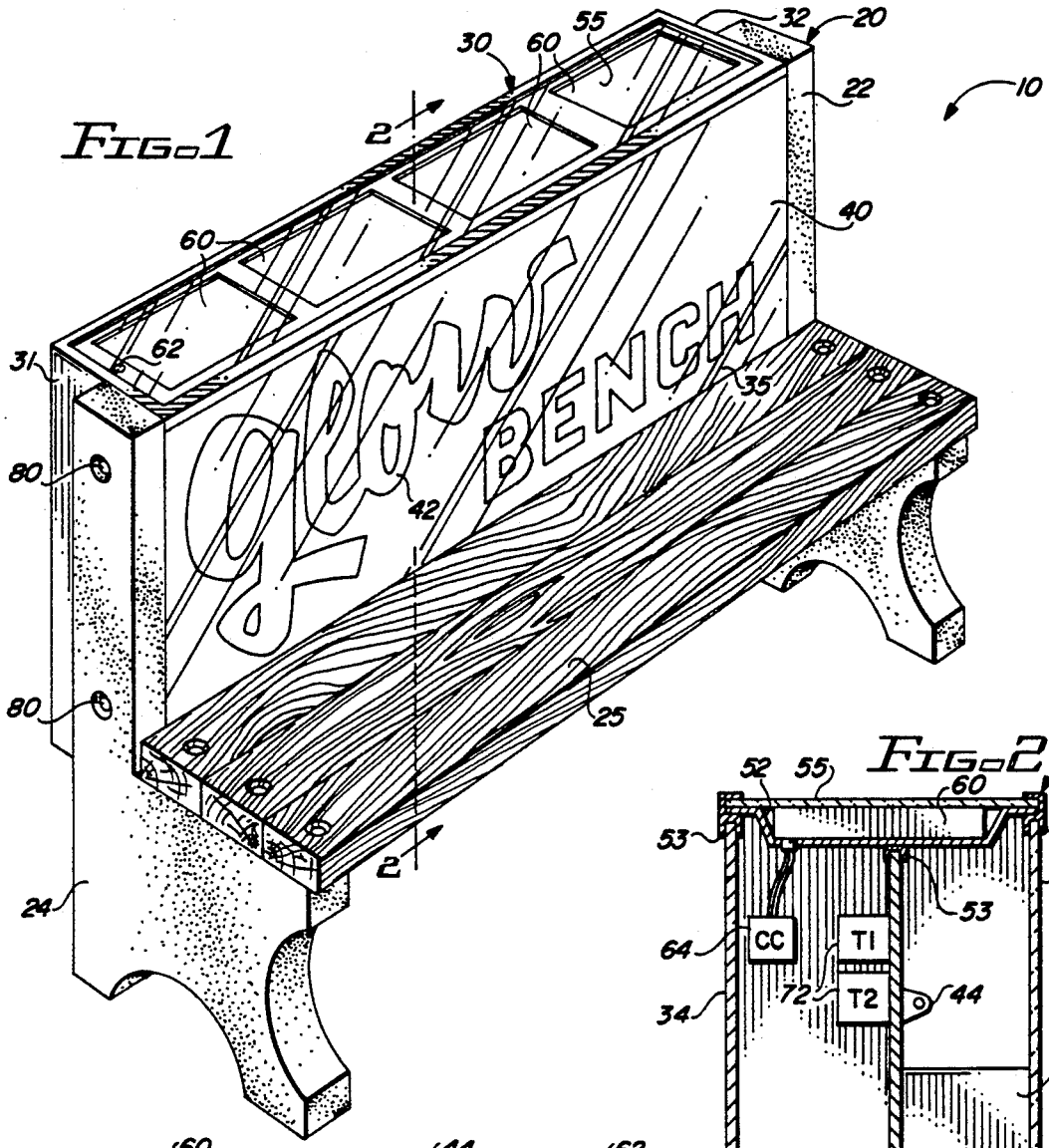
FIG. 2
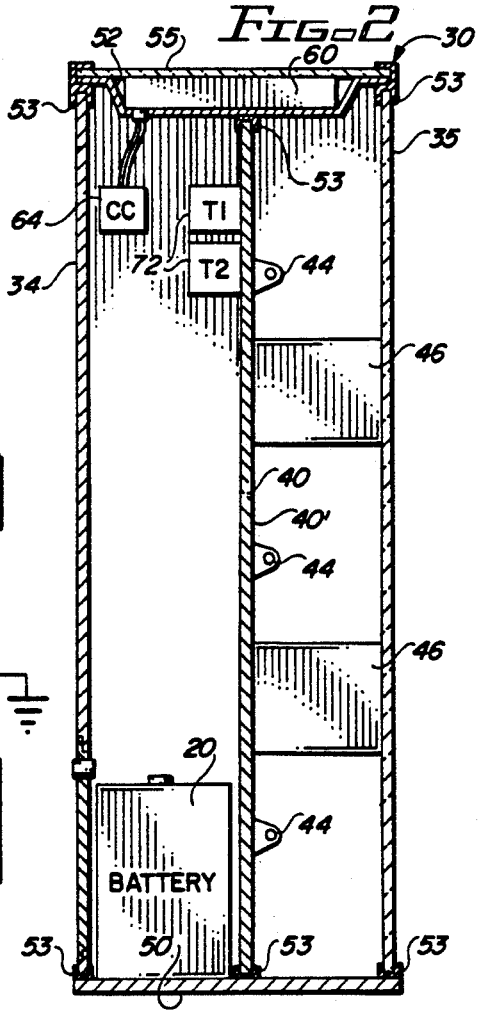
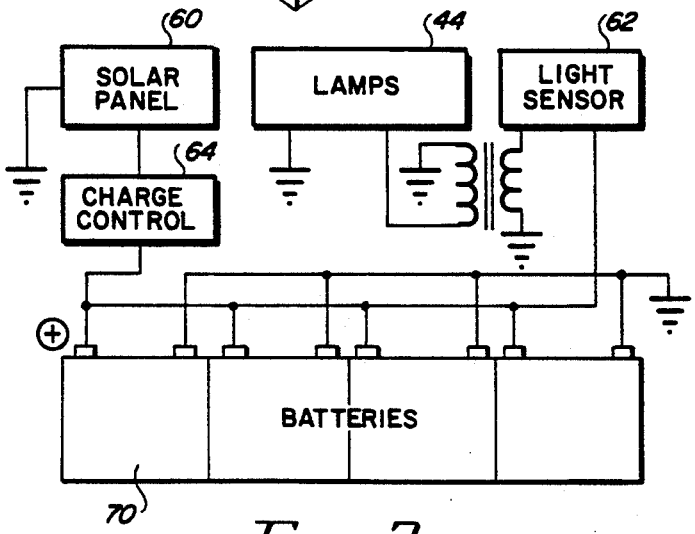
FIG. 3

ILLUMINATED ADVERTISING BENCH

BACKGROUND OF THE INVENTION

1. Field of the Invention

The present invention relates to an advertising bench to be positioned at a bus stop or like outdoor location and display advertising indicia thereon day and night, the bench becoming visibly illuminated at night to make the advertising indicia readily viewable, thereby maximizing the effectiveness of the outdoor advertising space by assuring the advertising can be read day and night.

2. Description of the Related Art

Outdoor benches such as those commonly found at bus stops and sidewalks are often used for advertising purposes. Commonly, the bench back includes a billboard type advertisement disposed thereon such that a passersby will be able to read the advertisement. Unfortunately, when it becomes dark, the advertising indicia becomes unreadable unless the bench happens to be in a well lit area. This inevitably limits the impact of these advertisements to the daytime. Accordingly, it would be highly beneficial to provide an advertising bench which will be equally effective at night, when most individuals are not at work and are out. Further, the presence of an illuminated advertising would make the vicinity of each bench become more illuminated making the area safer at night.

The impact of neon or argon type illuminated signs is well known and the present invention utilizes this attractive feature to maximize the advertising effect of bench back advertising. Further, the present invention utilizes a low voltage, rechargeable power source to minimize the cost of the display, utilizes the illumination only when it is dark and truly needed, keeps the lighting and advertising safe and shielded behind the transparent front panel, and provides the benefits of increased illumination to the vicinity of the bench.

SUMMARY OF THE INVENTION

The present invention is directed towards an advertising bench to be used in outdoor areas such as bus stops and park sidewalks. The advertising bench primarily includes a bench having a pair of spaced support members and a seating platform supportably disposed between support members. The seating platform provides a planar support upon which individuals may sit. Further disposed between the support members is a seat back assembly. The seat back assembly includes a back panel, a mid panel, and a front panel positioned in spaced apart relation from one another. A pair of opposite side panels supportably hold the back panel, mid panel, and front panel therebetween and are secured to the support members by fastening means such that the seat back assembly is secured in a vertical orientation between the support members of the bench. The front panel of the seat back assembly is transparent so that an exposed face of the mid panel may be visible therethrough. This exposed face of the mid panel is where advertising indicia is displayed. In addition to the advertising indicia, lighting means are visible from the exposed face, the lighting means being adapted to draw attention to the advertising bench when illuminated. In order to illuminate the lighting means, rechargeable power means are disposed between the mid panel and the back panel, thereby supplying the lighting means with necessary power and being concealed from view such that only the advertising indicia and lighting means are visible. In order to securely contain the panels and any items held therebetween, the seat back assembly includes a bottom panel and a top panel. The top panel is specifically adapted to include charging means therein which facilitate the recharging of the power means, thereby allowing longlasting continuous use. Finally, switching means are included to turn on the lighting means when the vicinity of the bench becomes dark, and turn off the lighting means when the vicinity of the bench is well lit, thereby assuring that the lighting means are in use only when most effective.

It is an object of the present invention to provide an advertising bench which will be equally effective during daylight and nighttime hours as an advertising medium.

Another object of the present invention is to provide an advertising bench which will draw added attention and be highly attractive, compared with normal billboard type bench advertising, thereby resulting in greater impact advertising.

A further object of the present invention is to provide an advertising bench assembly which while becoming automatically illuminated when it is dark and necessary is completely self-contained and requires no external power source or switching.

Yet another object of the present invention is to provide an advertising bench which provides substantially bright illumination from argon lighting, but does not require a high voltage power source, thereby being substantially safe and not requiring frequent battery changing.

Another object of the present invention is to provide an advertising bench which will illuminate an area in the vicinity of the bench, thereby making normally poorly lit areas safer at night.

Still another object of the present invention is to provide an advertising bench which while being illuminated is still capable of normal, safe, and effective use as a bench by persons wanting to sit down.

BRIEF DESCRIPTION OF THE DRAWINGS

For a fuller understanding of the nature of the present invention, reference should be had to the following detailed description taken in combination with the accompanying drawings in which:

FIG. 1 is an elevated perspective view of the advertising bench.

FIG. 2 is a cross-sectional view of the seat back assembly of the present invention, along line 2—2 of FIG. 1.

FIG. 3 is a detailed electrical diagram of the advertising bench.

Like reference numerals refer to like parts throughout the several views of the drawings.

DETAILED DESCRIPTION OF THE PREFERRED EMBODIMENT

Shown throughout FIGS. 1–3, the present invention is directed towards an advertising bench, generally indicated as 10. The advertising bench 10 is adapted to be positioned in a variety of outdoor locations such as in a park or at a bus stop for the dual purpose of providing a place where people may sit and displaying advertising for the public. As best seen in FIGS. 1 and 2, the advertising bench 10 includes primarily a sturdy bench 20 having a pair of support members 22 and 24, a seating platform 25, and a seat back assembly 30. The support members 22 and 24 are disposed in spaced apart relation from one another and supportably hold the seating platform 25 in a horizontal, seating position therebetween. Further, the support members 22 and 24 hold the seat back assembly 30 vertically disposed therebetween, thereby providing a complete and comfortable seating location. The seat back assembly 30 includes primarily a back panel 34, a front panel 35, and a mid panel 40. These panels 34, 35 and 40 are supportably held in spaced apart relation from one another by a pair of opposite side panels 31 and 32, and a bottom panel 50 and top panel 52. More particularly, the bottom panel 50 and top panel 52 includes a plurality of elongate tracks 53 which secure the panels 34, 35 and 40 in position. Further, fastening means, preferably in the form of elongate secure bolt 80, pass through the opposite side panels 31 and 32, and into the support members 22 and 24 to assure secure positioning of the seat back assembly 30 between the support members 22 and 24.

The front panel 35 of the seat back assembly 30 is made of a transparent, strong plastic-type material, preferably polycarbonate. The front panel 35 is transparent such that an exposed face 40' of the mid panel 40 will be completely visible therethrough. The exposed face 40' of the mid panel 40 includes advertising indicia 42 and a plurality of lighting means 44 disposed thereon. The advertising indicia 42 and lighting means 44 are coordinated in accordance with the wants and desires of a particular advertiser, and the lighting means 44 are preferably in the form of argon tube lights. Other types of lights such as neon may also be effectively utilized, however, argon is the preferable type. Accordingly, by including lighting means 44 with the advertising indicia 42, the advertising indicia 42 becomes readily visible at night and a great deal of attention is drawn to the advertising indicia 42.

In order to assure that the front panel 35, which is necessarily strong yet flexible, will not be collapsed towards the mid panel 40 when inward pressure is placed on the front panel 35 such as during use of the bench, a reinforcing means is provided and includes a plurality of narrow elongate spacer members 46 preferably disposed between the front panel 35 and mid panel 40. These spacer members 46 are formed of a strong, transparent material such as acrylic, thereby providing maximum support while not obstructing the view of the advertising indicia 42 disposed on the mid panel 40. Further, so as to facilitate the changing of the advertiser utilizing the advertising bench 10, the top panel 52 is removable such that the mid panel 40 may be slid out from its holding track 53 and replaced with an all new mid panel 40 having new advertising indicia 42 and lighting means 44 thereon. Concealed between the mid panel 40 and the back panel 34 is the advertising bench 10 power source. The power source is preferably in the form of a plurality of rechargeable gel cell batteries 70. These gel cell batteries 70 supply low amounts of voltage, are quickly rechargeable, and thereby provide longlasting safe use. Such that these low voltage batteries 70 may be effectively utilized to power the lighting means 44, the batteries 70 are connected to the lighting means 44 through a pair of transformers 72 which are specifically adapted to step up the voltage emitted by the batteries 70 to a usable quantity required by the lighting means 44.

In order to assure low maintenance of the advertising bench 10 and maximize the efficiency thereof, the batteries 70 are adapted to be recharged by charging means 60 disposed in the top panel 52 of the seat back assembly 30. In the preferred embodiment, the charging means 60 are in the form of a plurality of solar cells which utilize the sun's energy to maintain a complete charge in the battery 70. These solar cells 60 are shielded from direct contact by a transparent shield panel 55 disposed atop the top panel 52. The functioning of the charging means 60, as well as the turning on and off of the lighting means 44 are controlled by switching means of the advertising bench 10. In the preferred embodiment, the switching means include a photocell light sensor 62 disposed in the top panel 52. This photocell light sensor 62 detects when there is substantial light in the vicinity of the bench 20, thereby making the lighting means 44 unnecessary, and further detect when the vicinity of the bench 20 is poorly lit, such as at night. Accordingly, by use of the light sensor 62, the lighting means 44 will be automatically turned on when it becomes dark, and will be automatically turned off during daylight hours where their impact is minimized. The switching means also include a charge controls 64 which coordinates the functioning of the charging means 60. The charge controls 64 are adapted to disconnect the charge means 60 from the batteries 70 when the batteries 70 are in use and powering the lighting means 44, and reconnect the charging means 60 and provide for charging of the batteries 70 when the lighting means 44 are off during the day and the solar cells of the charging means 60 are most effective to provide a charge for the batteries 70. The advertising bench 10 is therefore completely self-contained, does not need external switching or power, is completely safe as the lighting means 44 are well shielded from users of the bench 20 and only use very low voltage batteries, and provides a high impact, highly visible advertising medium at night.

The present invention as described is the preferred embodiment at the time of invention, however variations consistent with the claims, such as the use of the front and back of the seat back assembly for advertising purposes, should also be included.

Now that the invention has been described,

What is claimed is:

1. An advertising bench comprising:

a bench having a pair of spaced support members, a seating platform supportably disposed between said support members, and a seat back assembly, said seat back assembly including a back panel, a removably mounted mid panel, and a front panel disposed in spaced apart relation from one another, said seat back assembly further including a pair of opposite side panels, said side panels supportably holding said back panel, said mid panel, and said front panel therebetween, said front panel being transparent so as to enable visibility of an exposed face of said mid panel therethrough, said exposed face of said mid panel including advertising indicia formed thereon and further including lighting means connected thereto, said lighting means being structured and disposed to illuminate and draw attention to said advertising indicia, power supply means structured and disposed to provide power for said lighting means, said power supply means being disposed within said seat back assembly and being rechargeable, said seat back assembly also including a bottom panel and a top panel, said top panel including charging means therein, said charging means being structured and disposed to charge and recharge said power supply means, switching means structured and disposed to turn said lighting means on and off, reinforcing means mounted between said mid panel and said front panel and structured for preventing external pressure on said front panel from collapsing said front panel towards said mid panel, and fastening means structured and disposed to secure said seat back assembly in a vertical orientation to and between said spaced support members of said bench.

2. An advertising bench as recited in claim 1 wherein said power supply means includes a plurality of rechargeable gel cell batteries.

3. An advertising bench as recited in claim 2 wherein said power supply means further includes a pair of transformers connected between said batteries and said lighting means so as to step up voltage from said batteries and enable lower voltage batteries to be effectively used.

4. An advertising bench as recited in claim 3 wherein said charging means include a plurality of solar cells interconnected with said batteries.

5. An advertising bench as recited in claim 4 wherein said switching means include charge controls structured and disposed to disconnect said solar cells from said batteries when said lighting means are on, and reconnect said solar cells with said batteries when said lighting means are off.

6. An advertising bench as recited in claim 5 wherein said switching means further include a photo cell light sensor disposed on said top panel of said seat back assembly so as to turn off said lighting means when exterior light is detected and turn on said lighting means when only small amounts of exterior light are detected by said photo cell light sensor.

7. An advertising bench as recited in claim 6 wherein said lighting means includes at least one argon light.

8. An advertising bench as recited in claim 7 wherein said top panel is removable such that said mid panel may be slidably removed and replaced with a new, different mid panel.

9. An advertising bench as recited in claim 8 wherein said top panel includes a transparent shield panel thereon to protect said solar cells.

10. An advertising bench as recited in claim 1 wherein said fastening means includes a plurality of bolts passing through said side panels of said seat back assembly into said support members of said bench.

11. An advertising bench as recited in claim 1 wherein said reinforcing means comprises at least one spacer member mounted between said mid panel and said front panel such that external pressure on said front panel during use of the bench will not collapse said front panel towards said mid panel.

* * * * *